United States Patent [19]

Sedlatschek et al.

[11] 4,167,912

[45] Sep. 18, 1979

[54] SEWING MACHINE STITCH LENGTH OVERRIDE AND FEED BALANCE FOR DIGITAL FEED ACTUATORS

[75] Inventors: Robert L. Sedlatschek, Bridgewater; Oswald M. Porter, Livingston; Donald R. Davidson, Berkeley Heights, all of N.J.

[73] Assignee: The Singer Company, New York, N.Y.

[21] Appl. No.: 846,880

[22] Filed: Oct. 31, 1977

[51] Int. Cl.[2] ..... D05B 3/04

[52] U.S. Cl. ..... 112/158 E; 112/314

[58] Field of Search ..... 112/158 E, 203, 210, 112/121.11; 310/49, 48

[56] References Cited

U.S. PATENT DOCUMENTS

| | | | |
|---|---|---|---|
| 2,906,217 | 9/1959 | Myska | 112/121.11 X |
| 3,425,376 | 2/1969 | Brynge et al. | 112/203 X |
| 3,459,145 | 8/1969 | Ramsey et al. | 112/121.11 |

*Primary Examiner*—Werner H. Schroeder
*Assistant Examiner*—Andrew M. Falik
*Attorney, Agent, or Firm*—David L. Davis; Robert E. Smith; Edward L. Bell

[57] ABSTRACT

A sewing machine is disclosed wherein positioning of the work feeding regulator is controlled by a digital actuator responsive to digital signals applied thereto. The positioning of the work feeding regulator is thereby adjustable in discrete increments. A manual override and feed balance mechanism is provided for effecting continuous positioning of the work feeding regulator.

10 Claims, 5 Drawing Figures

SEWING MACHINE STITCH LENGTH OVERRIDE AND FEED BALANCE FOR DIGITAL FEED ACTUATORS

BACKGROUND OF THE INVENTION

This invention relates to sewing machines and, more particularly, to sewing machine work feeding mechanisms controllable in response to the successive application thereto of digital signals.

In recent years, so called "electronic" sewing machines have gained in popularity and have met with commercial success in both industrial and domestic applications. These electronic sewing machines typically include a memory unit for storing in digital form information to control both the needle positioning mechanism and the work feeding mechanism to automatically produce a desired pattern. Signals generated from the stored information are applied to signal responsive actuators for selectively positioning the needle and the work feeding mechanism. These actuators may be of either the analog type or the digital type. An analog actuator is responsive to an analog signal for positioning its associated mechanism at a point along a continuum between two extreme positions. The present invention is concerned with digital actuators wherein the actuator responds to digital input signals to position its associated mechanism at a selected one of a plurality of incrementally displaced discrete points between two extreme positions. A problem encountered with actuators of the digital type is that it is often desired to position the associated mechanism at a point intermediate two of the predetermined discrete positions.

It is therefore an object of this invention to provide a manually operable continuously movable override for a digital actuator.

A further problem inherent in the use of digital actuators becomes apparent when such an actuator is used in conjunction with a work feeding mechanism for a sewing machine. The feeding characteristics of different fabrics differ widely so that feed settings which result in equal stitch lengths in forward and reverse directions for one particular fabric, will not necessarily result in equal length stitch formation in forward and reverse directions when another fabric is sewn upon. The machine therefore has to be "balanced" for the particular fabric being stitched. When utilizing an actuator of the digital type, the balance point may lie between two of the predetermined incrementally displaced discrete positions.

It is therefore another object of this invention to provide a manually operable balance control for a sewing machine utilizing a digital actuator for the work feeding mechanism.

SUMMARY OF THE INVENTION

The foregoing and additional objects are attained in accordance with the principles of this invention in a sewing machine having a work feeding mechanism and a feed regulator operatively connected to the work feeding mechanism to influence magnitude and direction of feed motion, the feed regulator being variable in position over a predetermined range of positions between successive stitches, and a driving device operatively connected to impart discrete incremental movement to the feed regulator over the predetermined range of positions in response to digital feed signals applied thereto, by providing manually operable means for imparting continuous movement to the work feeding regulator.

In accordance with an aspect of this invention, the entier driving device is shifted in position.

BRIEF DESCRIPTION OF THE DRAWING

The foregoing will be more readily apparent upon reading the following description in conjunction with the drawing in which.

DETAILED DESCRIPTION

Figure 1:
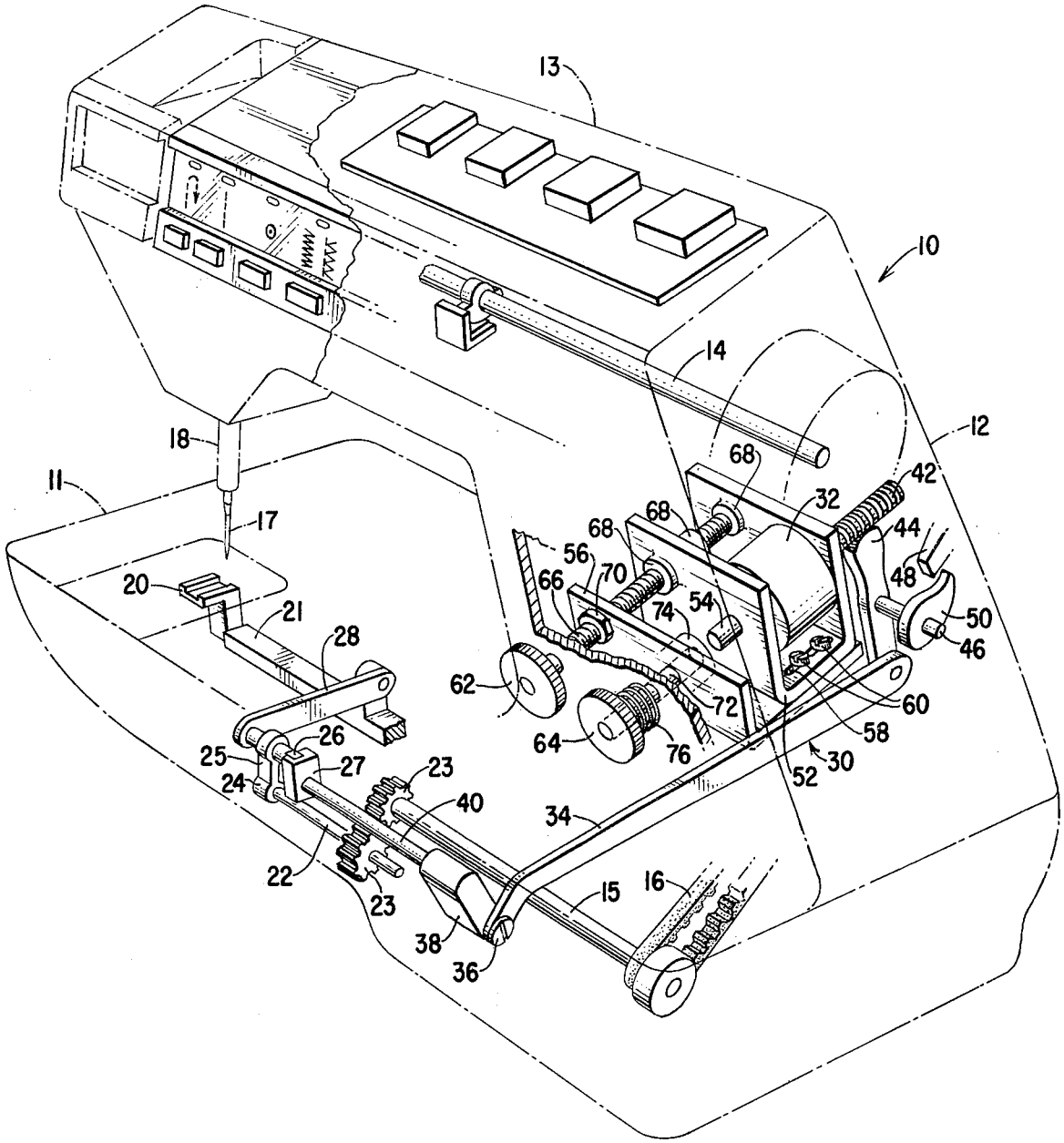
FIG. 1 is a perspective view of a sewing machine including fragments of a typical work feeding mechanism and illustrating a first embodiment of apparatus constructed in accordance with the principles of this invention.

FIG. 1 illustrates a sewing machine with fragments of the work feeding mechanism which contributes to changes in the relative coordinates of successive needle penetrations. As shown in phantom lines in FIG. 1, the sewing machine casing 10 includes a bed 11, a standard 12 rising from the bed and a bracket arm 13 overhanging the bed. The driving mechanism of the sewing machine includes an arm shaft 14 and a bed shaft 15 interconnected by a timing belt 16 in the standard. A needle 17 carried for endwise reciprocation by a needle bar 18 is mounted for movement in the bracket arm 13. Any conventional connections (not shown) may be used between the arm shaft and the needle bar for imparting needle reciprocation.

The work feeding mechanism includes a feed dog 20 carried by a feed bar 21. In FIG. 1 a mechanism is illustrated for imparting work transporting movement to the feed dog 20 including a feed drive shaft 22 driven by gears 23 from the bed shaft 15, a cam 24 on the feed drive shaft 22, a pitman 25 embracing the cam 24 and connected to reciprocate a slide block 26 in a slotted feed regulating guideway 27. A link 28 pivotally connects the pitman 25 with the feed bar 21 so that depending upon the inclination of the guideway 27, regulation of the magnitude and direction of the feed stroke of the feed dog 20 may be controlled.

The inclination of the guideway 27 in the present invention may be controlled by an electromechanical digital feed actuator indicated generally by the reference numeral 30. The actuator 30 illustratively includes as its main driving element a stepping motor 32. Stepping motors per se are well known in the art and function to rotate in fixed angular increments in accordance with pulses applied thereto from associated control circuitry. Neither the stepping motor nor its associated control circuitry form a part of the present invention and hence will not be described in detail herein. Only as much detail as is necessary for an understanding of the present invention will be set forth hereinafter.

The actuator 30 includes a link 34 pivoted at 36 to a rock arm 38 carried on a rock shaft 40 secured to the guideway 27. The position of the link 34 is controlled by a worm 42 and a worm gear segment 44, pivoted on a shaft 46. The worm 42 is an extension of the shaft of the stepping motor 32. Rotation of the stepping motor 32 causes rotation of the worm 42 and the consequent pivoting of the worm gear segment 44, which controls the position of the link 34 and the inclination of the guideway 27. Illustratively, a reference stop 48 may be provided to cooperate with a member 50 mounted on the shaft 46. The reference stop position of the shaft 46 may illustratively correspond to the maximum forward stitch length and may be utilized by the machine control circuitry (not shown) at machine start up.

A disadvantage of the arrangement shown in FIG. 1, and likewise a disadvantage of all digital actuators, is that the inclination of the guideway 27, and hence the amplitude of the stitch length, may be controlled only by fixed incremental amounts. These fixed incremental amounts may not provide for a fine setting of the stitch length and further, may not allow an exact feed balance to be obtained. The arrangement illustrated in FIG. 1 overcomes this disadvantage and allows for the obtaining of both feed balance and fine adjustment of stitch length to values intermediate the discrete incremental values obtainable through the use of a digital actuator.

In accordance with the principles of this invention, a first embodiment of this invention is constructed wherein the stepping motor 32 is mounted on a motor mounting bracket 52 in a conventional manner. The shaft 54 of the motor 32 extends out through one side of the bracket 52 and the worm 42 extends out the other side of the bracket 52 through suitable openings therein. A guide bracket 56 is provided, which is fixedly secured to the sewing machine casing 10 in a conventional manner, and the motor mounting bracket 52 is arranged to be slidably secured to the guide bracket 56. Toward that end, the motor mounting bracket 52 includes a first slot 58 and a second slot (not shown) at its other end. These slots are parallel to each other and are also parallel to the axis of the motor shaft 54 and the worm 42. Four shoulder screws 60 (only two of which are shown) are utilized to secure the motor mounting bracket 52 to the guide bracket 56. The shoulder screws 60 fit through the slots 58 and are tightened sufficiently to provide frictional engagement so as to hold the motor mounting bracket 52 but to allow the motor mounting bracket 52 to slide along the guide bracket 56 when the frictional engagement is overcome by operator applied forces.

To accomplish the objects of this invention, two operator controlled knobs 62 and 64 are provided. The knob 62 is utilized to control the feed balance and the knob 64 is utilized to provide a manual stitch length setting. The balance knob 62 is mounted on a shaft 66. The shaft 66 extends through suitable openings in the guide bracket 56 and the motor mounting bracket 52. Four retaining rings 68, two on each side of the upstanding portions of the motor mounting bracket 52, are provided to prevent axial movement of the shaft 66 with respect to the motor mounting bracket 52. A nut 70 is fixedly secured to the guide bracket 56. A portion of the shaft 66 is provided with threads matching the internal threads of the nut 70. This threaded portion of the shaft 66 extends on both sides of the guide bracket 56. Operator controlled rotation of the knob 62 thus causes the shaft 66 to be axially displaced through the nut 70 relative to the guide bracket 56. The amount of displacement is dependent on the amount of rotation of the knob 62 and the direction of displacement is dependent upon the direction of rotation of the knob 62. The axial displacement of the shaft 66 causes the entire motor mounting bracket 52 to be moved relative to the guide bracket 56. The shaft 66 is arranged with its axis parallel to the axis of the motor shaft 54 and the worm 42. Therefore, rotation of the knob 62 causes the worm 42 to be axially displaced. This axial displacement of the worm 42 results in the pivoting of the worm gear segment 44 about the shaft 46, resulting in an angular displacement of the guideway 27. In this manner, proper feed balance may be obtained without a rotation of the shaft of the stepping motor 32.

Alternatively, the nut 70 may be secured to the motor mounting bracket 52 and the retaining rings 68 may be secured to the guide bracket 56 so that when the knob 62 is rotated, the shaft 66 is not axially displaced, but rather only the motor mounting bracket 52 is moved.

The knob 64 is utilized to provide manual control of the stitch length over a continuum of values so that the operator is not limited by the discrete setting applied by a digital control. The knob 64 is mounted on a shaft 72 which extends through suitable openings in the machine casing 10 and the guide bracket 56. At the end of the shaft 72 opposite the knob 64 is a friction clutch 74. A spring 76 surrounds the shaft 72 between the machine casing 10 and the knob 64 and is adapted to bias the knob 64 away from the casing 10. This outward bias is limited by the friction clutch 74 acting as a stop against the guide bracket 56. The shaft 72 is axially aligned with the motor shaft 54. When the machine operator sets the stitch length, the knob 64 is forced toward the casing 10 against the action of the spring 76 until the friction clutch 74 engages the end of the motor shaft 54. At this time, the knob 64 is rotated to turn the motor shaft 54 and consequently the worm 42 so that the inclination of the guideway 27 may be adjusted to provide any desired stitch length over a continuum within the permissible range.

Figure 2:
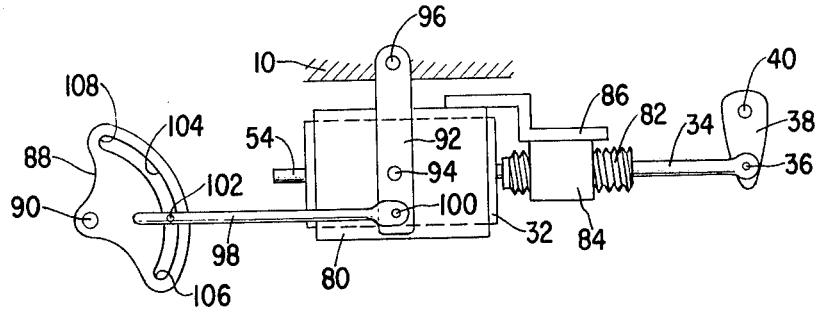
FIG. 2 illustrates a second embodiment of this invention.

An alternative construction for obtaining manual stitch length override and feed balance in a stepping motor controlled work feeding mechanism is illustrated in FIG. 2, wherein elements common to the embodiment shown in FIGS. 1 and 2 have the same reference numerals. FIG. 2 is intended to be schematic in its representation and hence the mechanisms illustrated therein are not shown in great detail. As shown in FIG. 2, the stepping motor 32 is mounted in a motor mounting frame 80. The shaft 54 of the stepping motor 32 has one end terminating in a threaded portion 82. The threaded portion 82 extends through a nut 84 mounted on a nut guide 86 which in turn is slidably mounted on the motor mounting frame 80 in a conventional manner. The nut 84 is connected to the link 34 which is pivoted at 36 to the rock arm 38 carried on the rock shaft 40 which in turn is secured to the guideway 27 (FIG. 1). Thus, rotation of the shaft 54 of the stepping motor 32 causes the nut 84 to be axially displaced to effect a desired inclination of the guideway 27. Manual control of the inclination of the guideway 27 is achieved by providing a balance cam 88, pivoted at 90. The balance cam 88 is connected to an operator controlled knob (not shown) for rotation about 90. The motor mounting frame 80 is connected to a pair of motor mounting levers 92 (only the closer one of which is shown) at a motor alignment pivot 94. The levers 92 are connected to the sewing machine casing 10 at a pivot 96. A first end of a link 98 is connected to the lever 92 at a pivot point 100. The other end of the link 98 has a cam follower 102 mounted thereon. The cam follower 102 rides within a slot 104 of the balance cam 88. The slot 104 provides the camming surface and is configured as a portion of a helix so that its end 106 is further from the pivot point 90 than is its end 108. Thus, when the balance cam 88 is rotated under operation control, this causes an approximately linear displacement of the stepping motor 32, in turn producing a desired inclination of the guideway 27 without motor shaft rotation.

Figure 3B:
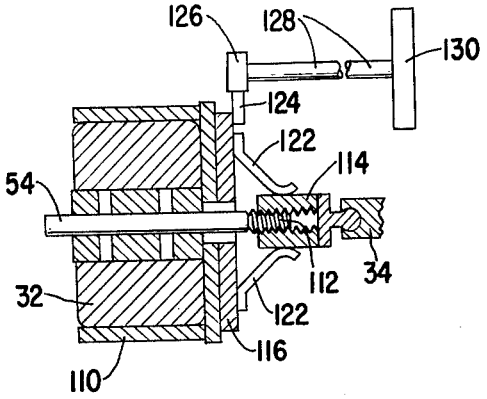
FIGS. 3A and B illustrate a third embodiment of this invention, with FIG. 3B being a sectional view along the line 3B—3B of FIG. 3A.
Figure 3A:
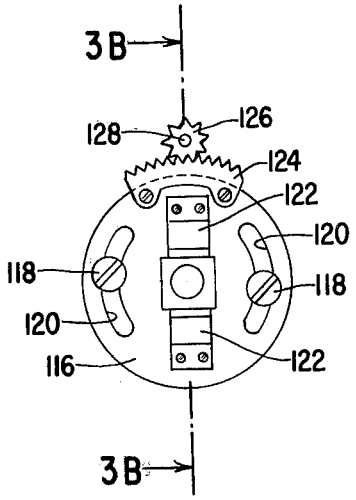

A third embodiment of apparatus constructed in accordance with the principles of this invention is depicted in FIGS. 3A and 3B. As shown therein, the stepping motor 32 is held in a motor mount 110 which in turn is secured to the sewing machine casing 10 in a conventional manner. The shaft 54 of the stepping motor 32 has a threaded end portion 112 which is threaded into a nut 114. The nut 114 in turn is secured to a link 34, illustratively by a ball joint. To afford manual adjustment, a nut rotation plate 116 is provided. The plate 116 is secured to the motor mount 110 by shoulder screws 118 which extend through a slot 120 in the plate 116. The screws 118 are sufficiently tightened to provide frictional forces to only allow the plate 116 to be rotated under operator control. Secured to the plate 116 are spring members 122 which prevent the nut 114 from rotating relative to the plate 116. Also secured to the plate 116 is a gear segment 124. Meshed with the gear segment 124 is a gear 126 which is mounted on a shaft 128. The shaft 128 is terminated by a knob 130. Operator control is effected by the operator turning the knob 130 which in turn causes rotation of the plate 116 through the action of the gear 126 and the gear segment 124. Rotation of the plate 116 causes rotation of the nut 114 which moves the link 34 to effect a desired inclination of the guideway 27 (FIG. 1).

Figure 4:
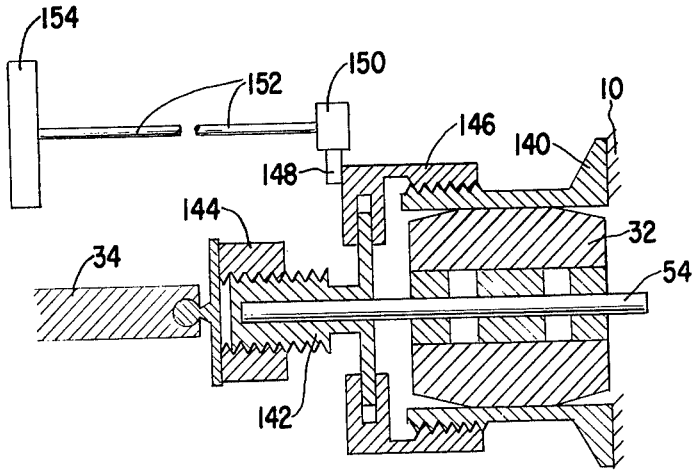
FIG. 4 illustrates a fourth embodiment of this invention.

A fourth embodiment constructed in accordance with the principles of this invention is shown in FIG. 4 wherein the stepping motor 32 is secured to a motor mount 140, which in turn is secured to the sewing machine casing 10. The shaft 54 of the stepping motor 32 is terminated by a disc and screw assembly 142. The screw portion of the assembly 142 is threaded through a nut 144 which in turn is connected to the link 34 through a ball joint. Rotation of the stepping motor shaft 54 causes an axial displacement of the nut 144 which in turn causes the link 34 to move, thereby changing the inclination of the guideway 27 (FIG. 1). To afford manual control of the inclination of the guideway 27, a disc retainer 146 is threaded on the motor mount 140. Rotation of the disc retainer 146 may be effected by an arrangement similar to that shown and described with respect to FIGS. 3A and 3B. A gear segment 148 secured to the disc retainer 146 is meshed with a gear 150 secured to a shaft 152, which is terminated by a knob 154. When an operator turns the knob 154, the disc retainer 146 is rotated through the coaction of the gear 150 with the gear segment 148. Rotation of the disc retainer 146 results in an axial displacement of the disc retainer 146 and a consequent axial displacement of the disc and screw assembly 142. This causes a linear motion of the nut 144 and hence an adjustment of the inclination of the guideway 27. It is to be noted that this arrangement causes an axial displacement of the motor shaft 54 and so may only be utilized where the stepping motor 32 is so designed that the motor coils are wide enough that the shaft rotor is exposed to a proper amount of magnetic flux over a range of linear positions of the shaft 54.

Accordingly, there has been described an arrangement in a sewing machine having a work feeding regulator selectively positionable in response to digital signals for providing a manually operable control to achieve positioning of the work feeding regulator over a continuum, in addition to the discrete positioning provided by the digital actuator. It is understood that the above-described arrangements are merely illustrative of the application of the principles of this invention. Numerous other arrangements may be devised by those skilled in the art without departing from the spirit and scope of this invention, as defined by the appended claims. While this invention has been illustrated with respect to a stepping motor as the digital actuator, it is contemplated that the principles of this invention may be applied to arrangements utilizing other types of digital actuators. For example, if a whipple tree arrangement of linkages is utilized to control the work feeding regulator, the entire whipple tree linkage may be mounted in a manner so as to be movable as a whole under control of an operator.

Having thus set forth the nature of this invention what is claimed herein is:

1. In a sewing machine having a work feeding mechanism and a feed regulator operatively connected to said work feeding mechanism to influence magnitude and direction of feed motion, said feed regulator being variable in position over a predetermined range of positions between successive stitches and a driving device operatively connected to impart discrete incremental movement to said feed regulator over said predetermined range of positions in response to digital feed signals applied thereto, the improvement comprising manually operable means for imparting continuous movement to said feed regulator.

2. The sewing machine according to claim 1 wherein said driving device includes a stepping motor having a shaft operatively connected to position said feed regulator and said manually operable means includes means for rotating said shaft.

3. The sewing machine according to claim 1 wherein said manually operable means includes means for moving said driving device.

4. The sewing machine according to claim 3 wherein said driving device is fixedly secured to a mounting member and said mounting member is slidably secured with respect to the case of said sewing machine and said manually operable means includes a rotatable control knob accessable to the sewing machine operator and means for converting rotary motion of said control knob into translational motion to slide said mounting member.

5. The sewing machine according to claim 4 wherein said driving device includes a stepping motor having a shaft operatively connected to position said feed regulator and said manually operable means further includes means for rotating said shaft.

6. The sewing machine according to claim 5 wherein said means for moving said shaft includes a second rotatable control knob accessable to the sewing machine operator, said second knob being mounted to a first end of a control shaft coaxial with said stepping motor shaft and means mounted on the second end of said control shaft for engaging said stepping motor shaft.

7. The sewing machine according to claim 6 wherein said engaging means includes a friction clutch.

8. The sewing machine according to claim 7 further including means for biasing said friction clutch out of contact with said stepping motor shaft.

9. The sewing machine according to claim 1 wherein said driving device includes a stepping motor having a shaft with an externally threaded portion thereon, means operatively connecting said shaft to said feed regulator, said connecting means including a nut threaded onto the threaded portion of said stepping motor shaft, the rotation of said stepping motor shaft causing an axial displacement of said nut so as to position said feed regulator, nut holding means for preventing rotation of said nut, and said manually operable means includes means for rotating said nut holding means.

10. The sewing machine according to claim 1 wherein said driving device includes a stepping motor having a shaft with an externally threaded portion thereon, means operatively connecting said shaft to said feed regulator, said connecting means including a nut threaded onto the threaded portion of said stepping motor shaft, the rotation of said stepping motor shaft causing an axial displacement of said nut so as to position said feed regulator, nut holding means for preventing rotation of said nut, and said manually operable means includes means for axially displacing said stepping motor shaft.

* * * * *